US009263008B2

(12) United States Patent
Okano

(10) Patent No.: US 9,263,008 B2
(45) Date of Patent: Feb. 16, 2016

(54) HARMONICA

(71) Applicant: Katsuo Okano, Saitama (JP)

(72) Inventor: Katsuo Okano, Saitama (JP)

( * ) Notice: Subject to any disclaimer, the term of this patent is extended or adjusted under 35 U.S.C. 154(b) by 0 days.

(21) Appl. No.: 14/637,104

(22) Filed: Mar. 3, 2015

(65) Prior Publication Data

US 2015/0179153 A1 Jun. 25, 2015

Related U.S. Application Data

(63) Continuation of application No. PCT/JP2012/072907, filed on Sep. 7, 2012.

(51) Int. Cl.
*G10D 7/12* (2006.01)

(52) U.S. Cl.
CPC ..... *G10D 7/123* (2013.01)

(58) Field of Classification Search
CPC ..... G10D 7/123
See application file for complete search history.

(56) References Cited

U.S. PATENT DOCUMENTS 364,610 A * 6/1887 Stratton ..... G10D 7/123 84/377
588,107 A * 8/1897 Fairfield ..... G10D 7/123 84/377
611,237 A * 9/1898 Curtis ..... G10D 7/123 84/377
863,960 A * 8/1907 Yates ..... G10D 7/123 84/377
995,967 A * 6/1911 Hill ..... G10D 7/123 84/378
1,623,175 A * 4/1927 Friedel ..... G10D 7/123 84/377
1,676,154 A * 7/1928 Perry ..... G10D 7/123 84/377
2,340,333 A * 2/1944 Magnus ..... G10D 7/123 84/377
2,420,450 A * 5/1947 Sonnen ..... G10D 7/123 84/377
3,580,125 A * 5/1971 Heatwole ..... G10D 7/123 84/377
7,265,286 B1 * 9/2007 Lin ..... G10D 7/123 84/377
2015/0179153 A1 * 6/2015 Okano ..... G10D 7/123 84/377

FOREIGN PATENT DOCUMENTS

JP 10-49141 A 2/1998

* cited by examiner

*Primary Examiner* — Robert W Horn
(74) *Attorney, Agent, or Firm* — Muncy, Geissler, Olds & Lowe, P.C.

(57) ABSTRACT

The present invention provides a harmonica having advanced functions and a simple structure, which can produce three fundamental chords in each of major and minor modes and which can be also used as a chromatic harmonica. The harmonica includes a pair of a blow reed and a draw reed in each of an upper part and a lower part of a hole and has four tone rows of a tone row for the upper blow reeds, a tone row for the upper draw reeds, a tone row for the lower blow reeds, and a tone row for the lower draw reeds. To three of the four tone rows are assigned three fundamental chords that each consist of four notes, and the remaining one tone row is used to supplement a note required to configure the chromatic scale.

5 Claims, 6 Drawing Sheets

FRONT VIEW

FRONT VIEW

REAR VIEW

SECTIONAL VIEW

FIG.4

FOR A MAJOR KEY

| | | | | | | |
|---|---|---|---|---|---|---|
| BLOW NOTES→ | DO | MI | SOL | TI-FLAT | DO | $C_7$ |
| DRAW NOTES→ | RE | FA | SOL | TI | RE | $G_7$ |

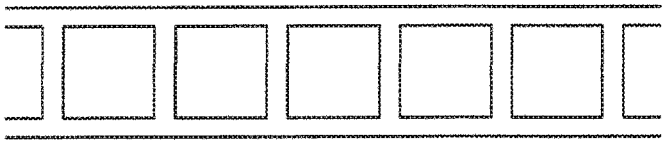

| | | | | | | |
|---|---|---|---|---|---|---|
| BLOW NOTES→ | RE-FLAT | SOL-FLAT | LA-FLAT | TI-FLAT | RE-FLAT | $D\flat_{6,SUS4}$ |
| DRAW NOTES→ | MI-FLAT | FA | LA | DO | MI-FLAT | $F_7$ |

FIG.5

FOR A NATURAL MINOR KEY

| | | | | | | |
|---|---|---|---|---|---|---|
| BLOW NOTES→ | LA | DO | MI | FA-SHARP | LA | $Am_6$ |
| DRAW NOTES→ | TI | RE | MI | SOL | TI | $Em_7/G_6$ |

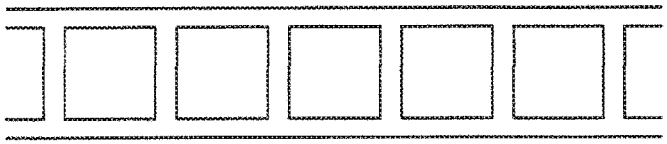

| | | | | | | |
|---|---|---|---|---|---|---|
| BLOW NOTES→ | DO-SHARP | RE-SHARP | SOL-SHARP | LA-SHARP | DO-SHARP | $D\sharp_{7,SUSU4}$ |
| DRAW NOTES→ | DO | RE | FA | LA | DO | $Dm_7/F_6$ |

FOR A HARMONIC MINOR KEY

| | | | | | | |
|---|---|---|---|---|---|---|
| BLOW NOTES→ | LA | DO | MI | SOL | LA | $Am_7/C_6$ |
| DRAW NOTES→ | TI | RE | MI | SOL-SHARP | TI | $E_7$ |

| | | | | | | |
|---|---|---|---|---|---|---|
| BLOW NOTES→ | DO-SHARP | RE-SHARP | FA-SHARP | LA-SHARP | DO-SHARP | $D\#m_7/F\#_6$ |
| DRAW NOTES→ | DO | RE | FA | LA | DO | $Dm_7/F_6$ |

FOR BOTH A MAJOR KEY AND A HARMONIC MINOR KEY

| | | | | | | |
|---|---|---|---|---|---|---|
| BLOW NOTES→ | LA | DO | MI | SOL | LA | $Am_7/C_6$ |
| DRAW NOTES→ | TI | RE | MI | SOL-SHARP | TI | $E_7$ |

| | | | | | | |
|---|---|---|---|---|---|---|
| BLOW NOTES→ | TI | RE | FA | SOL | TI | $G_7$ |
| DRAW NOTES→ | DO | RE | FA | LA | DO | $Dm_7/F_6$ |

HARMONICA

CROSS REFERENCE TO RELATED APPLICATIONS

This application is a Continuation of co-pending Application No. PCT/JP2012/072907, filed on 7 Sep. 2012, for which priority is claimed under 35 U.S.C. §120, the entire contents of all of which is hereby incorporated by reference.

BACKGROUND OF THE INVENTION

1. Field of the Invention

The subject invention relates to a four chord harmonica with advanced functions, which can produce three fundamental chords in each of major and minor modes and which can be also used as a chromatic harmonica.

2. Description of the Related Art

With a conventional harmonica, a user can play only two chords, a tonic chord when exhaling and a supertonic chord when inhaling. Accordingly, in base playing or arpeggio playing, the user cannot always provide natural expression appropriate for the chord progression of the song. With respect thereto, there is a "variable chord harmonica" provided by Mr. Haruo Tanahashi (see Patent Document 1). This harmonica enables playing of fundamental triads in a major key by modifying the tone rows of a slide chromatic harmonica; when the slide is not pushed, conventional tone rows are provided, while, when the slide is pushed, the blow notes constitute the subdominant chord and the draw notes constitute the dominant chord.

Patent Document 1: Japanese Unexamined Patent Application Publication No. 10-49141

However, such a harmonica is not suitable for advanced musical expression because of its disadvantage of losing a function as a chromatic harmonica. Despite the use of an expensive instrument of a slide harmonica having a relatively complicated structure, what can be played are mere three chords in a single key. It should be stated that the disadvantage of losing a function as a chromatic harmonica is greater than the advantage of being able to play the three fundamental chords.

Accordingly, purposes of the present invention are to solve the problem involved in the aforementioned related art and to provide a harmonica having advanced functions and a simple structure, which can produce three fundamental chords in each of major and minor modes and which can be also used as a chromatic harmonica.

It can be said that, when considering the present invention, the most difficult technical problem to overcome was eliminating a mere assumption or a stereotype. A conventional slide chromatic harmonica has the following tone rows.

| | | | | |
|---|---|---|---|---|
| Upper blow notes | C | E | G | C |
| Upper draw notes | D | F | A | B |
| Lower blow notes | C-sharp | E-sharp | G-sharp | C-sharp |
| Lower draw notes | D-sharp | F-sharp | A-sharp | B-sharp |

The C major scale can be played without pushing the slide, that is only with upper reeds, and when the slide is pushed, all the blow and draw notes are raised by a half step. Namely, two tone rows are required to express the major scale, and the other two tone rows are additionally used to express the other chromatic notes.

It can be conceived by anyone that, by assigning different chord tones to three tone rows among the four tone rows of the upper blow notes, upper draw notes, lower blow notes, and lower draw notes in this slide harmonica, fundamental triads can be produced. However, only with the remaining one tone row, the chromatic scale cannot be expressed, which seems to be inevitable. Anyone considers that, in order to produce fundamental chords, a function as a chromatic harmonica needs to be abandoned instead. Once they assume it to be inevitable, people will not consider the matter any further. Nobody will consider how the lost function can be restored or which tone rows should be provided to configure a harmonica that can produce three fundamental chords and can also function as a chromatic harmonica, for example.

Is this really impossible, I wonder? We can answer to this question as follows. Among the fundamental triads, when the dominant chord is provided as a seventh chord consisting of four notes and each of the remaining two chords is constituted by three notes, 10 reeds are sufficient for an octave. Further, in order to allow the harmonica to function as a chromatic harmonica, five other notes absent in the major scale may be added. Therefore, 15 reeds are necessary and sufficient for an octave. Meanwhile, a slide harmonica has four reeds for one hole, and one octave consists of four holes, so that 16 reeds are provided therein. Thus, if it is only asked whether or not such a harmonica can be configured, without specifically considering which tone rows should be provided, it is possible, and tone rows for enabling the creation of the harmonica certainly exist.

By the way, I also did not initially intend to make such a harmonica. My original purpose was to make a harmonica which can produce four chords, and it was the following simple one.

Upper blow notes Do Mi Sol * Do : C
Upper draw notes Re Fa Sol Ti Re : G7
Lower blow notes * Fa La Do * : F
Lower draw notes Re Fa La * Re : Dm Fundamental triads and the D minor (Dm) chord were merely assigned to the four tone rows. Then, two disturbing problems arose: one was that there were many blank spaces * because the chords other than the dominant chord were constituted by three notes; the other was that the F and Dm chords, having only one different note, were arranged. Because only four chords can be produced, chords having different characteristics should be desirably assigned; however, the situation will not change even if Dm is changed to A minor (Am) or E minor (Em). I have been thinking that notes should be arranged regularly and as naturally and beautifully as possible; the arrangement should not have anything missing or anything extra, and there should be strong necessity for the whole arrangement.

The aforementioned harmonica admittedly accomplished the original purpose of producing four chords. However, it was obviously imperfect as an instrument. I felt the necessity to fill the blank spaces *. So, then, I tried to build up every chord with four voices. There are three possibilities. The sixth chord, seventh chord, and major seventh chord. Which type should be selected? One approach is to add a note absent in the scale. This is because, although adding a note within the scale merely means filling a blank space *, adding a note absent in the scale can improve the functionality of the harmonica. For example, adding Ti-flat to the tonic chord to make a seventh chord enables playing of the major scale in a key that is a fourth higher than the original key of the harmonica. Also, adding Mi-flat to the subdominant chord enables playing of the major scale in a key that is a second lower than the original key. Further, the Dm chord is made to the D minor sixth (Dm6) chord, which has fewer overlaps with the subdominant chord. Consequently, We get a harmonica that can produce the four chords of the C seventh (C7), F seventh (F7), G seventh (G7), and Dm6 and can play major scales in three keys. This is fascinating enough already. But, we do not need to stop, because we have come here. We notice that it is easy to restore the function as a chromatic harmonica. A conventional chromatic harmonica is set so that, when the slide plate is pushed, all the seven notes are raised by a half step; however, such setting is unnecessary. As there are black keys for five notes in a piano, only five notes should be newly added. Since Ti-flat and Mi-flat are included in the three fundamental chords, when the remaining three notes of Re-flat, Sol-flat, and La-flat are added, the harmonica can produce the three fundamental chords in a major key and also can function as a chromatic harmonica.

SUMMARY OF THE INVENTION

The present invention has been made by: assigning different chords to upper blow reeds, upper draw reeds, lower blow reeds, and lower draw reeds in a slide harmonica or a harmonica that includes divider plates to have a function similar to that of a slide harmonica, in which three of the chords are fundamental chords that each consist of four notes; selecting appropriate chord types so that notes absent in the scale are included; and using the last tone row to supplement the remaining notes necessary to configure the chromatic scale.

Accordingly, there can be configured, without adding a complicated structure, a harmonica with advanced functions, which can produce three fundamental chords in each of major and minor modes and which also can play all twelve notes in the chromatic scale. With a complicated structure, high functionality may be achieved, but it will be a "mini-accordion" rather than a harmonica. There is value in achieving high functionality without adding a special structure.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which:

FIG. 4 is a diagram that shows tone rows for a major key provided by a four chord harmonica;

FIG. 5 is a diagram that shows tone rows for a natural minor key;

DETAILED DESCRIPTION OF THE INVENTION

The invention will now be described by reference to the preferred embodiments. This does not intend to limit the scope of the present invention, but to exemplify the invention.

Figure 1:
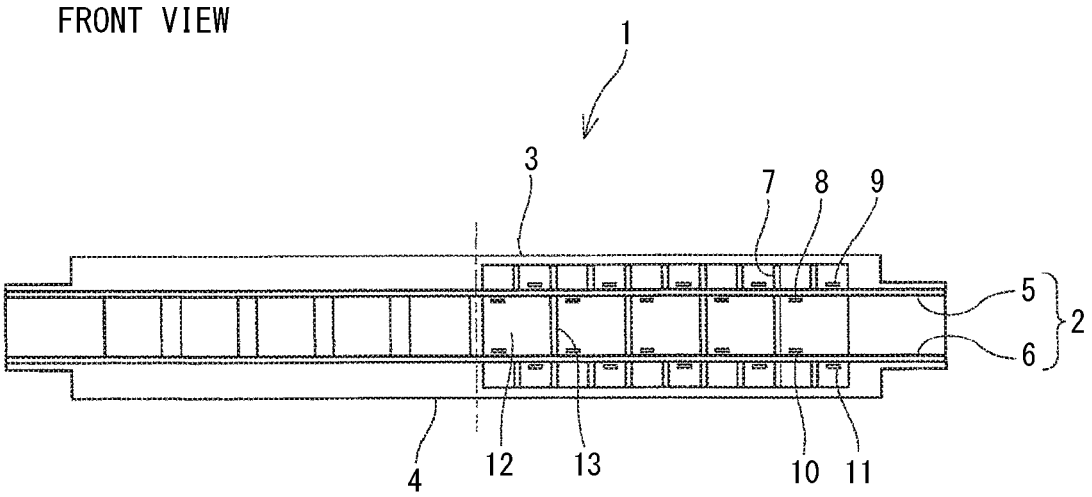
FIG. 1 is a front view that shows a structure of a harmonica.
Figure 2:
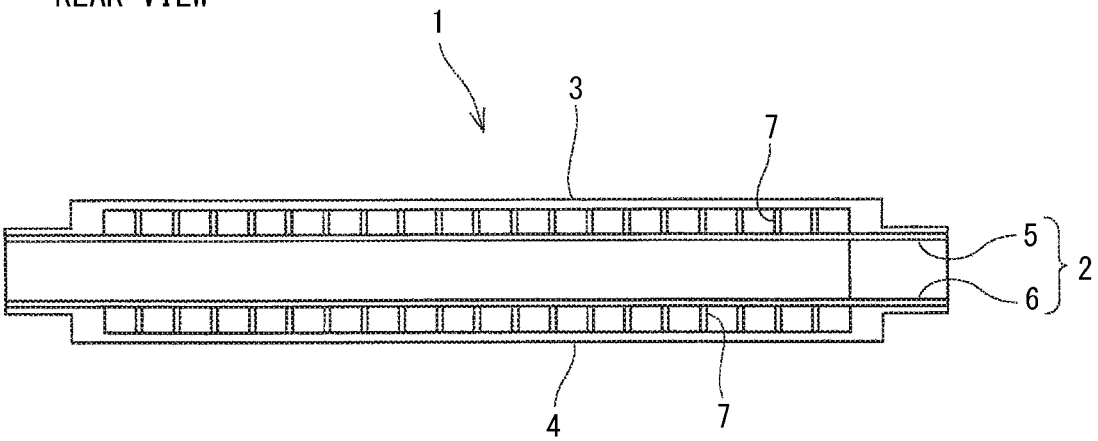
FIG. 2 is a rear view that shows a structure of the harmonica.
Figure 3:
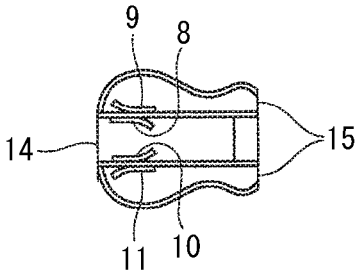
FIG. 3 is a sectional view that shows a structure of the harmonica.

In the following, an embodiment of the present invention will be described with reference to the drawings. FIGS. 1 and 2 show structures of a harmonica used in the present invention. A harmonica 1 includes a harmonica body 2 in which an upper reed plate 5 and a lower reed plate 6 are provided between top and bottom harmonica covers 3 and 4. On the upper reed plate 5 are provided a pair of a blow reed 8 and a draw reed 9 for a chamber 12, and on the lower reed plate 6 are provided a pair of a blow reed 10 and a draw reed 11 for a chamber 12. A divider plate 7 is provided between the reeds, thereby partitioning the spaces between the harmonica cover 3 and reed plate 5 and between the harmonica cover 4 and reed plate 6 into cells. There is not provided a hole or the like on either the top or bottom harmonica cover, but apertures 15 are provided on the rear side of the harmonica, similarly to a conventional harmonica. Accordingly, when a user blows or draws air into or from an air inlet 14, air flows into or out only through an aperture 15 on the rear side. When the harmonica 1 is viewed from the front, a certain gap is provided between the air inlets 14 so as to prevent a user from missing a note; however, the thickness of a divider 13 between the chambers 12 inside the harmonica is small so as not to make the gap between the holes too large.

The differences from conventional harmonicas other than slide harmonicas, such as ten-holes harmonicas, are only that four reeds are provided for one hole and that the interior is partitioned by the divider plates 7. With such a structure, when the lower part of the aperture 15 on the rear side is covered with a finger, only the upper reeds can be used to produce a sound, and, when the upper part of the aperture 15 on the rear side is covered with a finger, only the lower reeds can be used to produce a sound. This is functionally identical with a slide harmonica, which means that the subject harmonica, having a simpler structure, can provide the same functionality as a slide harmonica.

FIGS. 4-7 show specific tone rows provided by the harmonica 1, in which tone rows for the upper reed plate are shown in the upper part, while tone rows for the lower reed plate are shown in the lower part. In the figures, the movable-Do system is employed, and the name of the chord when La is defined as A is provided on the right side of the tone row. FIG. 4 shows an embodiment for a major key. The tone row for the upper blow reeds 8 is a pattern in which "Do Mi Sol Ti-flat" is repeated, the tone row for the upper draw reeds 9 is a pattern in which "Re Fa Sol Ti" is repeated, the tone row for the lower blow reeds 10 is a pattern in which "Re-flat Sol-flat La-flat Ti-flat" is repeated, and the tone row for the lower draw reeds 11 is a pattern in which "Mi-flat Fa La Do" is repeated, for an optional register. Since the same tone row patterns are repeated within the whole register, FIG. 4 only shows a register of an octave. However, the tone rows for three octaves will be as follows.

Blow notes of the upper reed plate:

Do Mi Sol Ti-flat Do Mi Sol Ti-flat Do Mi Sol Ti-flat

Draw notes of the upper reed plate:

Re Fa Sol Ti Re Fa Sol Ti Re Fa Sol Ti

Blow notes of the lower reed plate:

Re-flat Sol-flat La-flat Ti-flat Re-flat Sol-flat La-flat Ti-flat Re-flat Sol-flat La-flat Ti-flat Draw notes of the lower reed plate:

Mi-flat Fa La Do Mi-flat Fa La Do Mi-flat Fa La Do

In the case of a slide harmonica, when Ti-flat is changed to La in the upper blow notes above, a scale can be played without pressing the slide, so that someone may consider it more convenient. However, there is not a great difference in ease of use actually, so that a seventh chord should be considered as a standard chord type. In addition, the lower reed plate has to be used, after all, for performance including chord playing or that using the chromatic scale. However, since changing Ti-flat to La does not cause any significant problem, the case may be added as another embodiment. Although it is assumed that the harmonica 1 is configured to have the divider plates 7 inside, as described previously, the harmonica 1 may also be configured as a slide harmonica.

FIG. 5 shows an embodiment for a natural minor key. The tone row for the upper blow reeds 8 is a pattern in which "La Do Mi Fa-sharp" is repeated, the tone row for the upper draw reeds 9 is a pattern in which "Ti Re Mi Sol" is repeated, the tone row for the lower blow reeds 10 is a pattern in which "Do-sharp Re-sharp Sol-sharp La-sharp" is repeated, and the tone row for the lower draw reeds 11 is a pattern in which "Do Re Fa La" is repeated, for an optional register.

In the case of a natural minor key, fundamental triads are Am, Em, and Dm. In order to add a note absent in the scale to the triads, the options are to add Fa-sharp to the tonic chord to form A minor sixth (Am6) or to add Do-sharp to the dominant chord to form E minor sixth (Em6). However, the dominant chord should be desirably a seventh chord, and, as will be described later, all the types should desirably have the same configuration in which the upper blow notes form a tonic chord, the upper draw notes form a dominant chord, and the lower draw notes form a subdominant chord. If the dominant chord is a sixth chord and the tonic chord is a seventh chord, the two notes of Re and Fa in the scale cannot be produced only with the upper reeds. Therefore, the tonic chord should be a sixth chord, and the dominant chord should be a seventh chord. The tone rows for three octaves will be as follows.

Blow notes of the upper reed plate:

La Do Mi Fa-sharp La Do Mi Fa-sharp La Do Mi Fa-sharp

Draw notes of the upper reed plate:

Ti Re Mi Sol Ti Re Mi Sol Ti Re Mi Sol

Blow notes of the lower reed plate:

Do-sharp Re-sharp Sol-sharp La-sharp Do-sharp Re-sharp Sol-sharp La-sharp Do-sharp Re-sharp Sol-sharp La-sharp Draw notes of the lower reed plate:

Do Re Fa La Do Re Fa La Do Re Fa La

Figure 6:
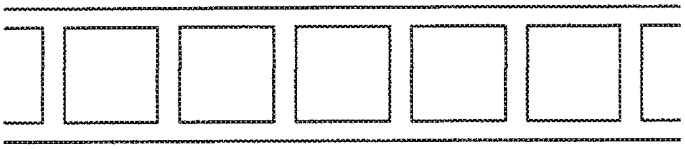
FIG. 6 is a diagram that shows tone rows for a harmonic minor key.

FIG. 6 shows an embodiment for a harmonic minor key. In the case of a harmonic minor key, fundamental triads are Am, Dm, and the E seventh (E7). Since Sol-sharp is included in E7, the tonic chord may be A minor seventh (Am7). Accordingly, notes to be newly added are the four notes of Do-sharp, Re-sharp, Fa-sharp, and La-sharp. Therefore, it is set that the tone row for the upper blow reeds 8 is a pattern in which "La Do Mi Sol" is repeated, the tone row for the upper draw reeds 9 is a pattern in which "Ti Re Mi Sol-sharp" is repeated, the tone row for the lower blow reeds 10 is a pattern in which "Do-sharp Re-sharp Fa-sharp La-sharp" is repeated, and the tone row for the lower draw reeds 11 is a pattern in which "Do Re Fa La" is repeated, for an optional register. Each of the lower blow notes is a half step higher than the corresponding lower draw note, and hence, the arrangement of notes of this type is easiest to remember. The tone rows for three octaves will be as follows.

Blow notes of the upper reed plate:

La Do Mi Sol La Do Mi Sol La Do Mi Sol

Draw notes of the upper reed plate:

Ti Re Mi Sol-sharp Ti Re Mi Sol-sharp Ti Re Mi Sol-sharp

Blow notes of the lower reed plate:

Do-sharp Re-sharp Fa-sharp La-sharp Do-sharp Re-sharp Fa-sharp La-sharp Do-sharp Re-sharp Fa-sharp La-sharp Draw notes of the lower reed plate:

Do Re Fa La Do Re Fa La Do Re Fa La

Figure 7:
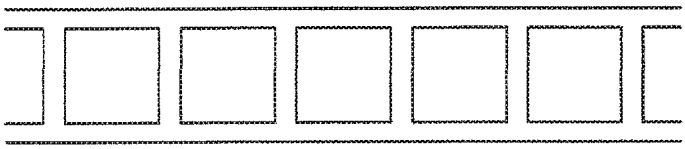
FIG. 7 is a diagram that shows tone rows used for both a major key and a harmonic minor key.

FIG. 7 shows an embodiment for both a major key and a harmonic minor key. A minor seventh chord can be used as a major sixth chord by changing the way of playing. Therefore, when the lower blow notes shown in FIG. 6 are changed to G7, as shown in FIG. 7, the tone rows can be used for both a major key and a harmonic minor key. The tone row for the upper blow reeds 8 is a pattern in which "La Do Mi Sol" is repeated, the tone row for the upper draw reeds 9 is a pattern in which "Ti Re Mi Sol-sharp" is repeated, the tone row for the lower blow reeds 10 is a pattern in which "Ti Re Fa Sol" is repeated, and the tone row for the lower draw reeds 11 is a pattern in which "Do Re Fa La" is repeated, for an optional register. In this case, the harmonica cannot be used as a chromatic harmonica, but a wide variety of chord works are enabled instead. For example, the dominant motion, such as D minor seventh (Dm7)→G7→C→F, chord progression of ascending and descending by a half step as frequently seen in flamenco, such as E→F→E, and chord progression of sequentially descending, such as Am→G7→F→E, can also be played. Since the function as a chromatic harmonica is not included, it is necessary to use bending or other techniques in order to produce a note absent in the scale. The tone rows for three octaves will be as follows.

Blow notes of the upper reed plate:

La Do Mi Sol La Do Mi Sol La Do Mi Sol

Draw notes of the upper reed plate:

Ti Re Mi Sol-sharp Ti Re Mi Sol-sharp Ti Re Mi Sol-sharp

Blow notes of the lower reed plate:

Ti Re Fa Sol Ti Re Fa Sol Ti Re Fa Sol

Draw notes of the lower reed plate:

Do Re Fa La Do Re Fa La Do Re Fa La

When the above type is configured as a harmonica having divider plates, a major scale or a natural minor scale can be played only with the upper and lower blow notes, and a harmonic minor scale can be played only with the upper and lower draw notes, through the operation of covering or uncovering the apertures with fingers. Since a melody can be played only with blow notes or draw notes, the harmonica enables fast playing that cannot be achieved with a conventional harmonica. Also, if a user becomes short of breath while playing with blow notes, the user can continue the playing by switching to draw notes anytime, so that the user may be able to play a long phrase without taking a breath. Only enabling a variety of chord works may be insignificant, but additionally enabling playing of a melody only with blow notes or draw notes makes this type of harmonica extremely attractive.

Figure 8:
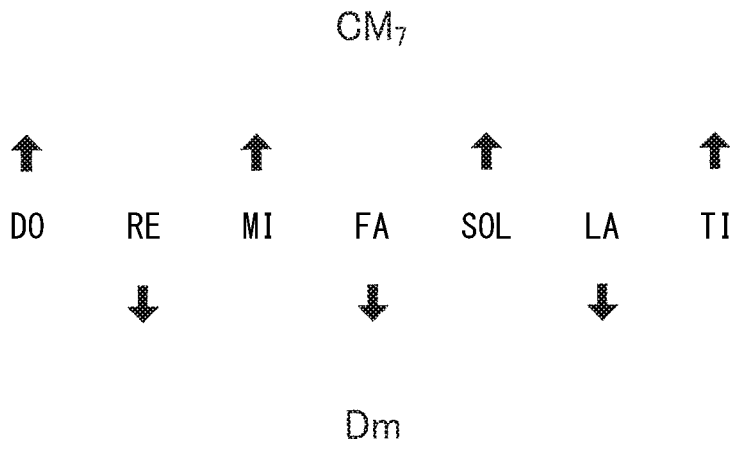
FIG. 8 is a diagram that shows distribution of notes of a major scale into diatonic chords.
Figure 9:
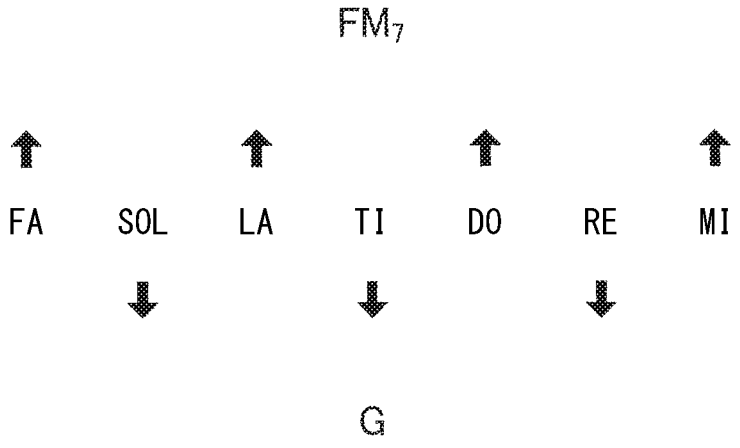
FIG. 9 is a diagram that shows distribution starting from Fa.
Figure 10:
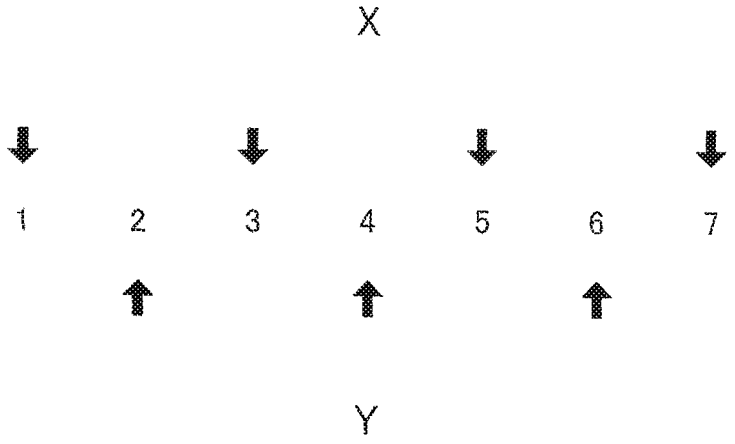
FIG. 10 is a conceptual diagram that shows reconstruction of a scale from two diatonic chords.

In consideration thereof, the tone rows shown in FIGS. 5 and 6 are also provided. Only with draw notes, a natural minor scale can be played in FIG. 5 and a harmonic minor scale can be played in FIG. 6. These features have not been incidentally obtained through trial and error or by changing tone rows but are results derived from a simple principle. If notes of a major scale are alternately distributed into two groups, there can be formed two diatonic chords having the interval of a second. For example, as shown in FIG. 8, when Do, Mi, Sol, and Ti are distributed to one group and Re, Fa, and La are distributed to the other group, there can be obtained C major seventh (CM7) and Dm. This can be started from any note; if the distribution is started from Fa, as shown in FIG. 9, Fa, La, Do, and Mi, forming F major seventh (FM7), and Sol, Ti, and Re, forming G, can be obtained. Conversely, if an original scale 1, 2, 3, . . . (specific notes will not be indicated) can be reconstructed from two diatonic chords X and Y in the scale, as shown in FIG. 10, the X and Y will have an interval of a second therebetween. Accordingly, we can tell as follows: a necessary and sufficient condition for reconstructing an original scale by combining two diatonic chords in the scale is that the diatonic chords have an interval of a second therebetween.

When the interval of a second is considered, Am7 could be replaced by the C sixth, for example.

This is a very simple matter, but it is important in considering tone rows of a harmonica. For example, when it should be determined whether a desired scale can be configured by combining two chords, only comparing the names of the two chords is required, without examining the constituent notes one by one, such as Do, Re, Mi, and so on.

Accordingly, when configuring a scale by combining two chords, of which one consists of three notes and the other of four notes, it is rational to combine diatonic chords that are made from the scale and have an interval of a second therebetween. The chord including lower notes consists of four notes, and the other chord consisting of three notes may be changed to either a sixth chord or a seventh chord by adding one note thereto. Also, the chord types can be changed by shifting the fourth note in the chord consisting of four notes to the other chord. In the case of CM7 and Dm, by shifting Ti in CM7 to Dm, there can be obtained the combination of C and Dm6, which are blow notes and draw notes of conventional harmonicas.

The same holds for a harmonic minor scale, but, since the note Sol-sharp is included, available chords include relatively peculiar chords, such as C+5 and G-sharp minor −5. In order to avoid them, the options are limited to the two pairs of Dm7 and E, and E7 and F. By changing the chord types, the latter pair can be changed to E and F6.

Since only the dominant and subdominant chords have an interval of a second therebetween among the three fundamental chords, in order to configure a scale only with blow notes or draw notes, both of the two chords may be constructed from blow notes or draw notes. However, since the tonic chord would be played for the longest time in a song, it is convenient to play the chord with blow notes. Consequently, both the dominant and subdominant chords are constructed from draw notes. For this reason, all the types including major and minor keys have the same pattern in which the upper blow notes form the tonic chord, the upper draw notes form the dominant chord, and the lower draw notes form the subdominant chord.

In the case of a major key shown in FIG. 4, the major scale cannot be played only with the draw notes because F7 is not a diatonic chord made from the C major scale. The combination previously cited is FM7 and G. However, if the lower draw notes are used to form FM7, the notes of Mi and Fa, having an interval of a half step, are consecutively arranged, which will be difficult to use. The combination can be changed to F and G6 by shifting Mi in FM7 to G, but providing a seventh chord as a basis would be natural. Even if a major scale is set to be played only with draw notes, a blow note has to be used to produce a note absent in the scale. If a melody consists only of notes in the scale, the harmonica shown in FIG. 7 may be used from the beginning.

If the above conditions are not considered, the four tone rows of the upper blow notes, upper draw notes, lower blow notes, and lower draw notes may be arbitrarily changed.

Although it is hard to master all the four types of note arrangement patterns, the major and harmonic minor type shown in FIG. 7 can be obtained only by changing the lower blow notes of the harmonic minor type shown in FIG. 6 to G7. Accordingly, if a user becomes acclimated to the harmonic minor type, the user can use the major and harmonic minor type in a similar manner, and vice versa. Also, the natural minor type shown in FIG. 5 is not indispensable, and the harmonic minor type will be sufficient in most cases. As a result, it will be sufficient to remember the two types of the major type and the harmonic minor type or the major type and the major and harmonic minor type.

As another embodiment, it can also be considered to use the harmonic minor type shown in FIG. 6 as a natural minor type by tuning Sol-sharp in the harmonic minor type to Sol-natural or by changing reeds. Although such a harmonica cannot be used as a complete chromatic harmonica, only the note Sol-sharp may be produced by bending. With this configuration, the three fundamental chords can be produced in each of a major key and a natural minor key. The arrangement of notes is easy to remember as it differs by only one note from the arrangement of the harmonic minor type, and is practical as it can also be used for a major key. Accordingly, when commercializing such a harmonica, a manufacturer may sell the harmonica with a replacement reed attached thereto so that a user can select a type according to the user's preference. In order to allow a user to easily change reeds, it would be better to bolt the reeds rather than to screw them.

Initially, I considered configuring the subject harmonica as a slide harmonica. The problems in the case are that, since a slide harmonica is expensive, a user has to bear a considerably great financial burden in order to play in multiple keys, and that there should be provided a mechanism for muting an arbitrary note for the case where a user wishes to play with simple chords consisting of three notes. However, these two problems have been solved simultaneously by employing the type of harmonica with divider plates.

With the harmonica structure with divider plates, in order to mute a particular note, an aperture on the rear side may be covered with a finger or plugged with a rubber stopper or the like. This is enabled inexpensively, placing a smaller financial burden on a user. Although it is also possible to configure the subject harmonica as a slide harmonica, the type of harmonica with divider plates would be superior in all respects.

The greatest appeal of a harmonica as an instrument is its compactness and simple structure. In this sense, it can be said that the harmonica with divider plates is based on the basics of a harmonica.

What is claimed is:

1. A harmonica comprising a pair of a blow reed and a draw reed in each of an upper part and a lower part of a hole and having four tone rows of a tone row for the upper blow reeds, a tone row for the upper draw reeds, a tone row for the lower blow reeds, and a tone row for the lower draw reeds, wherein one of the four tone rows is a pattern in which "Do Mi Sol Ti-flat" is repeated, one of the remaining three tone rows is a pattern in which "Re Fa Sol Ti" is repeated, one of the remaining two tone rows is a pattern in which "Re-flat Sol-flat La-flat Ti-flat" is repeated, and the remaining one tone row is a pattern in which "Mi-flat Fa La Do" is repeated.

2. A harmonica comprising a pair of a blow reed and a draw reed in each of an upper part and a lower part of a hole and having four tone rows of a tone row for the upper blow reeds, a tone row for the upper draw reeds, a tone row for the lower blow reeds, and a tone row for the lower draw reeds, wherein one of the four tone rows is a pattern in which "Do Mi Sol La" is repeated, one of the remaining three tone rows is a pattern in which "Re Fa Sol Ti" is repeated, one of the remaining two tone rows is a pattern in which "Re-flat Sol-flat La-flat Ti-flat" is repeated, and the remaining one tone row is a pattern in which "Mi-flat Fa La Do" is repeated.

3. A harmonica comprising a pair of a blow reed and a draw reed in each of an upper part and a lower part of a hole and having four tone rows of a tone row for the upper blow reeds, a tone row for the upper draw reeds, a tone row for the lower blow reeds, and a tone row for the lower draw reeds, wherein one of the four tone rows is a pattern in which "La Do Mi Fa-sharp" is repeated, one of the remaining three tone rows is a pattern in which "Ti Re Mi Sol" is repeated, one of the remaining two tone rows is a pattern in which "Do-sharp Re-sharp Sol-sharp La-sharp" is repeated, and the remaining one tone row is a pattern in which "Do Re Fa La" is repeated.

4. A harmonica comprising a pair of a blow reed and a draw reed in each of an upper part and a lower part of a hole and having four tone rows of a tone row for the upper blow reeds, a tone row for the upper draw reeds, a tone row for the lower blow reeds, and a tone row for the lower draw reeds, wherein one of the four tone rows is a pattern in which "La Do Mi Sol" is repeated, one of the remaining three tone rows is a pattern in which "Ti Re Mi Sol-sharp" is repeated, one of the remaining two tone rows is a pattern in which "Do-sharp Re-sharp Fa-sharp La-sharp" is repeated, and the remaining one tone row is a pattern in which "Do Re Fa La" is repeated.

5. A harmonica comprising a pair of a blow reed and a draw reed in each of an upper part and a lower part of a hole and having four tone rows of a tone row for the upper blow reeds, a tone row for the upper draw reeds, a tone row for the lower blow reeds, and a tone row for the lower draw reeds, wherein one of the four tone rows is a pattern in which "La Do Mi Sol" is repeated, one of the remaining three tone rows is a pattern in which "Ti Re Mi Sol" is repeated, one of the remaining two tone rows is a pattern in which "Do-sharp Re-sharp Fa-sharp La-sharp" is repeated, and the remaining one tone row is a pattern in which "Do Re Fa La" is repeated.

* * * * *